US005597052A

United States Patent [19]

Rogleja

[11] Patent Number: 5,597,052

[45] Date of Patent: Jan. 28, 1997

[54] DESCENDER

[76] Inventor: Boris Rogleja, 9 Nelson Avenue, Padstow NSW 2211, Australia

[21] Appl. No.: 515,503

[22] Filed: Aug. 15, 1995

[51] Int. Cl.[6] ..... B65H 59/14

[52] U.S. Cl. ..... 188/65.5; 182/5; 182/193

[58] Field of Search ..... 188/65.4, 65.5; 182/5, 6, 7, 191, 192, 193

[56] References Cited

U.S. PATENT DOCUMENTS

| | | | |
|---|---|---|---|
| 1,229,394 | 6/1917 | Abbramson | 182/193 |
| 4,580,658 | 4/1986 | Brda | 182/5 |
| 4,596,314 | 7/1986 | Rogelja | 188/65.5 |
| 5,054,577 | 10/1991 | Petzl et al. | 188/65.5 X |

*Primary Examiner*—Lee W. Young
*Attorney, Agent, or Firm*—Jordan and Hamburg

[57] ABSTRACT

A descender 10 having a resistance feed arrangement 14, 15 for a rope 5, a self-acting brake (12, 14, 15, 18) to automatically apply a braking force to the rope 5 in certain circumstances such as an emergency when the user is knocked unconscious, and a variable braking mechanism 21 which allows the user to selectively vary the braking force by moving a braking surface 24 in a direction away from the rope 5 to allow a controlled reduction of the braking force, and which will automatically return to a position for maximum braking force when released. Preferably, the variable braking mechanism 21 is in the form of a cam 22 selectively pivotal by means of a handle or lever 23 which may be connected to the tail end of the rope 5 by a retention arrangement 25 to allow easy actuation of the mechanism 21. In another embodiment, the descender 10 is provided with a sheave 48 as part of the resistance feed through the descender, and which is selectively freely rotatable for larger diameter ropes 5 and which may be rotatably locked for smaller diameter ropes. In this way, the resistance of the feed of the rope 5 through the descender 10 can be adjusted to suit different diameter ropes.

5 Claims, 5 Drawing Sheets

DESCENDER

TECHNICAL FIELD

The present invention relates to "descenders" for use in abseiling and in particular to an improved descender of the type which incorporates a self-acting brake,

BACKGROUND OF THE INVENTION

Abseiling is a technique used to descend steep surfaces such as cliff faces and is often used by persons involved in activities such as mountain climbing, canyoning and caving. In order to abseil down a cliff face, one end of a rope is made fast at the top of the cliff and the person making the descent then slides down the rope, The rope is passed either around the body of the person or more usually through a descender attached to a harness worn by the person such that the passage of the rope around the body or through the descender provides sufficient friction to slow the rate of descent to a safe speed, A descender comprises rope engaging surfaces around and between which the rope travels, along a tortuous path, to provide frictional engagement between the rope and the descender, The rate of descent is normally controlled by holding the free or tail end of the rope to control the tension on the rope where it emerges from the descender and thereby to control the degree of frictional engagement between the rope and the descender which in turn controls the rate of descent, Descenders used in abseiling vary greatly in performance and complexity, there being a variety of relatively simple devices which rely on frictional engagement between the rope and metal rings or racks about which the rope is wrapped, and a number of more complex descenders which incorporate a braking mechanism which allows the friction between the rope and the descender to be varied other than by simply controlling the free or tail end of the rope, The earliest of these more complex devices had a handle or lever which when operated tended to increase the friction between the descender and the rope. This type of descender was not a great improvement over the more simple devices as the brake was not self-engaging and therefore, if the user was knocked unconscious, he would fall in the same way as the user of the earlier devices.

The present invention is derived from a class of descenders wherein the variable braking action of the descender increases when the handle is released. Usually, the force required to initiate the braking action is provided by the frictional engagement of the descender with the rope travelling therethrough. It is also possible to have arrangements which are operated by springs. Spring operated arrangements have the disadvantage that the restoring force of the spring may reduce with age or the spring may become damaged without this being noticed by the user, thereby decreasing the effectiveness of the descender.

An improved type of descender was disclosed in U.S. Pat. No. 4,596,314 to the present applicant which provides a descender having a simplicity of construction and operation which was not achieved by earlier prior art descenders. The disclosure of this United States patent is incorporated herein by reference.

A disadvantage of the descender disclosed in U.S. Pat. No. 4,596,314 is that the actuation and release of the self-engaging brake can in some situations be rather abrupt or jerky. For example, it can be difficult for inexperienced users to smoothly control the braking action.

The first embodiment of the present invention is intended to provide a modification to the descender shown in U.S. Pat. No. 4,596,314 which allows the user to smoothly control the braking action and thereby avoid or minimize the Jerkiness which can be experienced with the use of this known type of descender.

Another problem with the descender disclosed in U.S. Pat. No. 4,596,314 is that, when used with a large diameter rope, too much resistance may exist between the rope and the descender as the rope moves along the tortuous path around the two spaced sheaves. The second embodiment of the present invention provides a means of solving or alleviating this problem.

DISCLOSURE OF THE INVENTION

The first embodiment of the present invention provides a descender for use in abseiling comprising:

a base having a connection means for connection to a harness or the like;

a pivotal member pivotally mounted on the base about a pivot axis extending generally normal thereto, the pivot axis being spaced from the connection means;

the pivotal member having first and second spaced projections for engaging a rope, the projections both extending generally parallel to the pivot axis with the first projection being disposed about the pivot axis and the second projection being located substantially on the opposite side of the pivot axis with respect to the connection means; the pivotal member also having a handle means to selectively pivot the pivotal member relative to the base;

the base further having a stop located adjacent the second projection which limits movement of the pivotal member and a variable braking mechanism associated with the stop having a braking surface which is selectively movable in a direction towards and away from the second projection;

whereby, in use, a rope passing around and between the first and second projections and between the second projection and the braking surface will have a resistance force applied thereto which is at a minimum when the second projection is selectively moved away from the stop member and variable braking mechanism by actuating the handle means, and is at a maximum when the handle means is released and the tension of the rope causes the second projection to bear against the stop and press the rope between the braking surface and the second projection and thereby create an additional braking force, and wherein the additional braking force can be reduced by selectively moving the braking surface in the direction away from the second projection.

Preferably, the braking surface of the variable braking mechanism in effect defines the stop against which, in use, the second projection can bear.

Preferably, the variable braking mechanism is in the form of a cam pivotally mounted on the base whereby various portions of a radially outer surface of the cam face the second projection when the cam is pivoted with respect to the base, the variable braking mechanism further having a lever to selectively pivot the cam and thereby vary the distance between the braking surface and the second projection.

Preferably, the lever has a retention means at a position spaced from the cam and through which, in use, a tail of the rope passes after emerging from between the second projection and the braking surface so that the lever will move with the tail of the rope and may be actuated by changing the position of the tail of the rope relative to the descender. Preferably, the retention means is in the form of a clip or ring. Alternatively, the retention means is in form of a pair of recesses in the lever through which, in use, the tail of the rope is threaded.

Preferably, the first and second projections define sheaves which are fixed relative to the pivotal member.

The second embodiment of the present invention provides a descender comprising:

a base having a connection means for connection to a harness or the like;

a pivotal member pivotally mounted on the base about a pivot axis extending generally normal thereto, the pivot axis being spaced from the connection means;

the pivotal member having first and second spaced projections for engaging a rope, the projections both extending generally parallel to the pivot axis with the first projection being disposed about the pivot axis and the second projection being located substantially on the opposite side of the pivot axis with respect to the connection means; the pivotal member also having a handle means to selectively pivot the pivotal member relative to the base;

the base having a braking surface located adjacent the second projection; and the first projection having an outer sheave whereby the sheave is freely rotatable about a central axis of the first projection to reduce the minimum friction between the descender and the rope passing through it.

In one preferred embodiment, a locking means is provided to lock the sheave relative to the pivotal member to increase friction when the descender is used with thinner ropes.

Preferably, the sheave is an annular part and the locking means is in the form of at least one hole in one axial end face of the annular part, an annular recess in the other axial-end face of the annular part, and at least one projection extending axially away from the pivotal member which is receivable in either the hole(s) or the annular recess; and wherein the annular part is selectively positioned so that either the annular recess or the hole(s) receive the projection(s), with the annular part being freely rotatable about the central axis when the projection(s) is/are received in the annular recess and being locked against rotation when the projection(s) is/are received in the hole(s).

Alternatively, the annular part has a hole and the pivotal member has a pin which is selectively movable into an extended position received in the hole in the annular part to lock it against rotation, and a retracted position to allow the annular part to be freely rotatable. It is also possible to swap the hole and pin between the annular part and the pivotal member.

Further, it is preferable that the centre or rotational axis of the first sheave is selectively adjustable with respect to the pivot axis so that the spacing between the second projection and the braking surface is adjustable to suit ropes having different diameters.

Preferably, the base is in the form of an elongate metal plate having first and second ends, the plate being substantially flat at least between the first end which includes the braking surface and the pivotal axis of the pivotal member.

Preferably, the braking surface is arranged around an axle which projects generally normal to the base at its first end, and wherein the descender further includes a retention plate for preventing disengagement of the rope from the descender when in use, the retention plate comprising an elongate metal plate substantially parallel to said base and located on the opposite end of the pivotal member with respect to said base, the retention plate having first and second ends and being pivotal about the pivot axis of the pivotal member between an open position and a closed position, and wherein the retention plate engages the axle and is substantially flat between the axle and the pivot axis.

Preferably, the connection means of the base is at the second end thereof.

BRIEF DESCRIPTION OF THE DRAWINGS

Preferred forms of the present invention will now be described by way of example with reference to the accompanying drawings, wherein.

BEST MODES OF CARRYING OUT THE INVENTION

Figure 1:
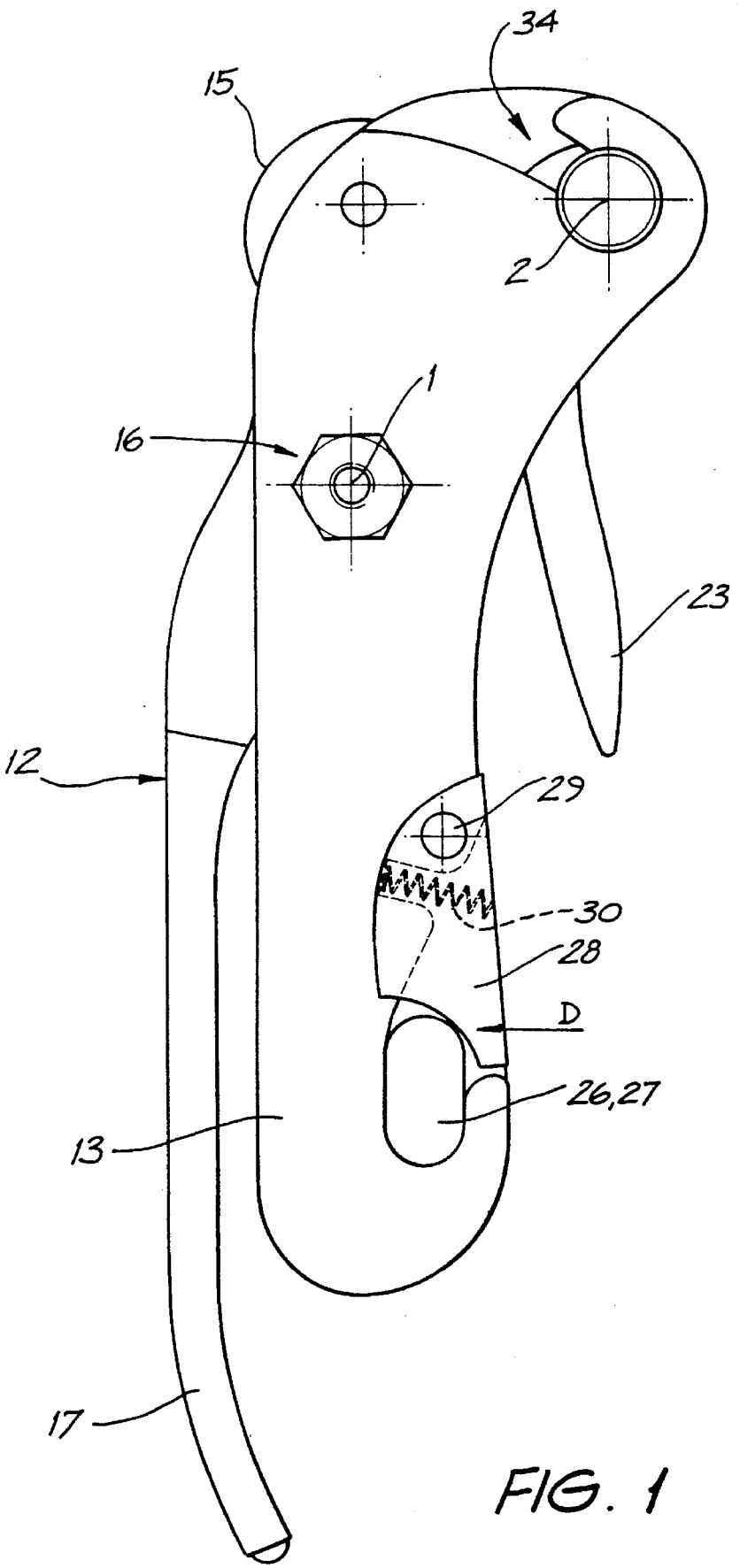
FIG. 1 is a top plan view of a first embodiment of the descender with the retention plate in its closed position.
Figure 2:
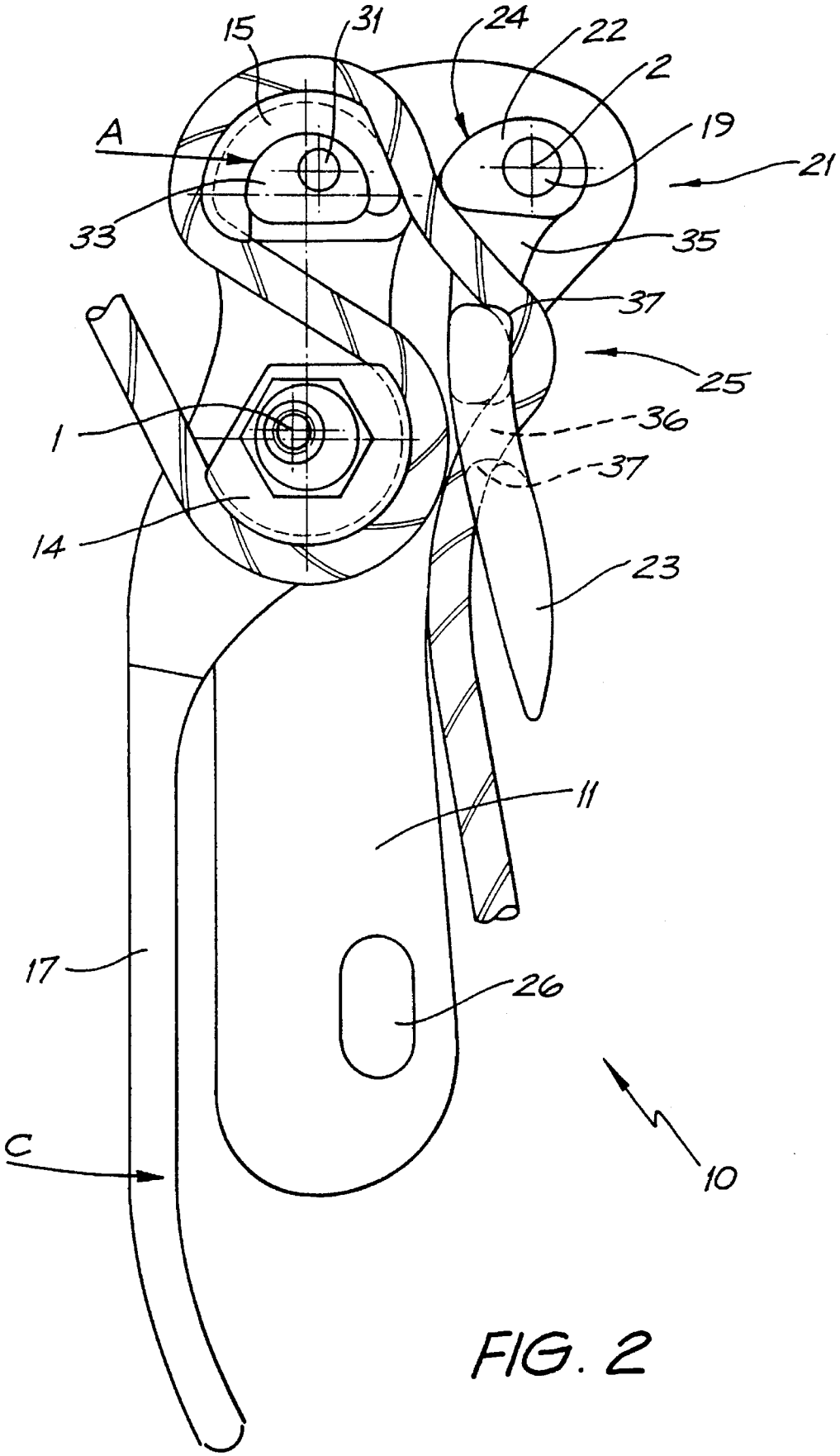
FIG. 2 shows the descender of FIG. 1 with the retention plate removed.
Figure 3:
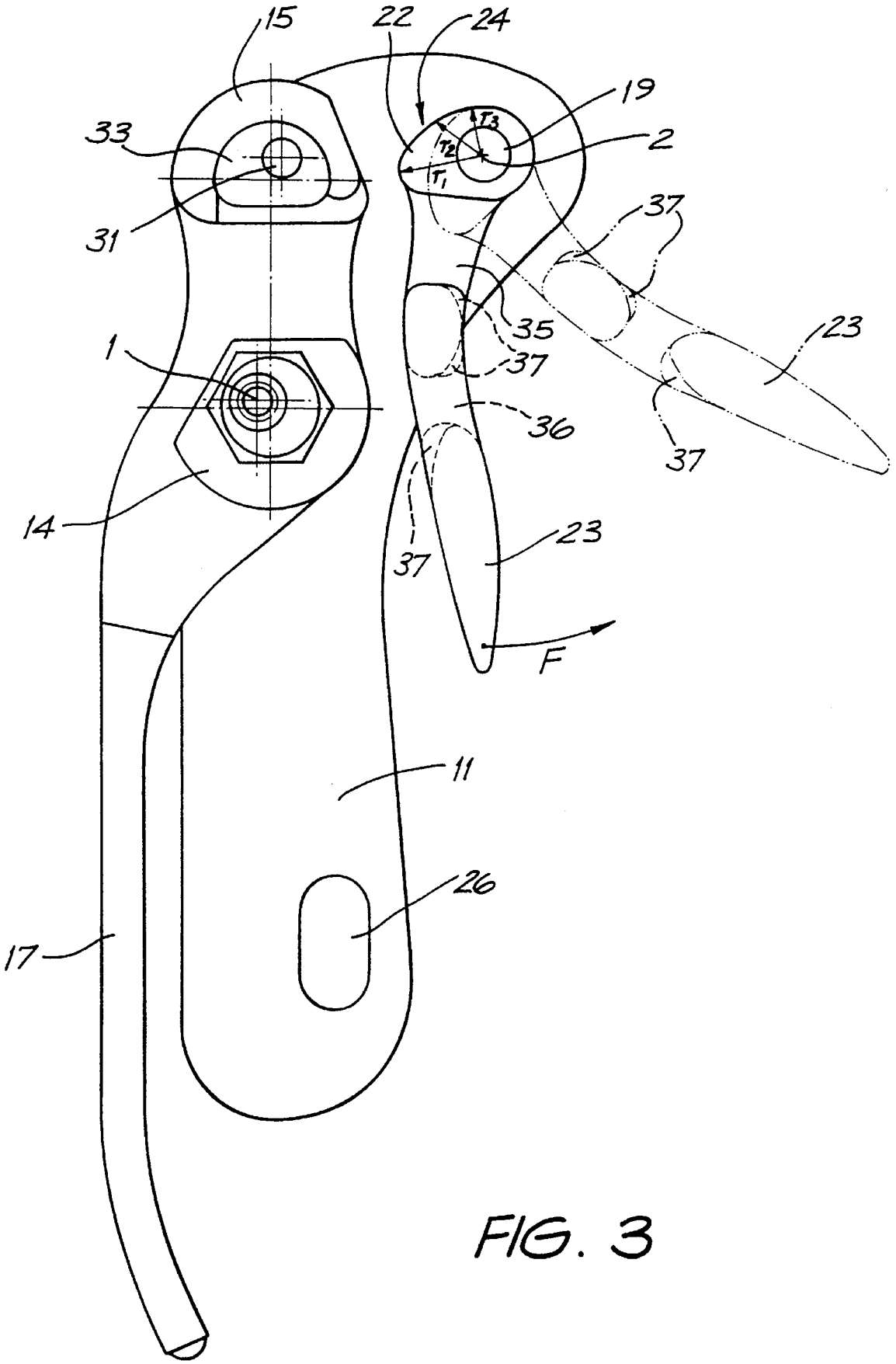
FIG. 3 shows a detailed view of the cam and lever of the variable braking mechanism.
Figure 4:
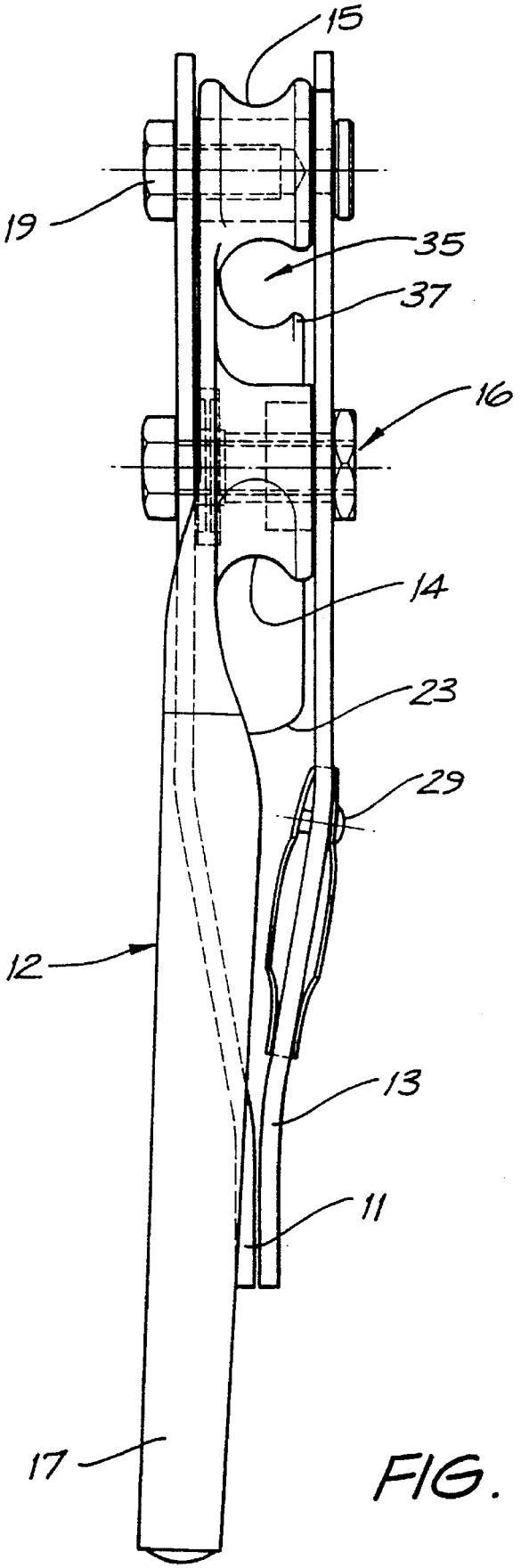
FIG. 4 shows a side elevational view of the descender of FIG. 1.

Referring to FIGS. 1–4, there is shown a descender 10 having a base plate 11, a pivotal member 12, and a retention plate 13.

The pivotal member 12 includes two spaced, non-rotatable sheaves 14 and 15 and is pivotally mounted to the baseplate 11 by a pivot arrangement 16 about a pivot axis 1. The effective centre of the first sheave 14 is either co-axial with, or slightly offset from, the pivot axis 1.

The pivotal member 12 extends away from the first sheave 14 in a generally opposite direction to the second sheave 15 to provide a lever handle 17 which, when moved in the direction C with respect to the baseplate 11, moves the second sheave 15 to a position remote from a variable braking mechanism 21 of the baseplate 11.

The baseplate 11 has a bolt 19 spaced from the pivot axis 1 and generally adjacent the second sheave 15.

The variable braking mechanism 21 is also mounted on the bolt 19 and is in the form of a cam 22 pivotal about a cam axle 2 defined by the bolt 19. The cam 22 defines a stop against which the second sheave bears when, in use, it is urged in the direction A. The mechanism 21 further has a lever 23 by which means the cam 22 is selectively pivoted about the cam axle 2. The radially outer surface of the cam 22 defines a braking surface 24 which has a varying radial distance from the cam axle 2. As such, the position of an opposing portion of the braking surface 24 relative to the second sheave 15 will vary depending on the position of the lever 23 relative to the base plate 11.

The lever 23 has a rope retention arrangement 25 at a position spaced from the cam 22. The retention arrangement 25 is in the form of a pair of recesses 35, 36. The first recess 35 is adjacent the cam 22 and faces away from the base plate 11. The second recess 36 is spaced from the first recess 35 away from the cam 22 and faces in an opposite direction to that of the first recess 35. The recesses 35, 36 are formed so that the rope can pass from between the cam 22 and the second sheave 15 to one side of the lever 23, through the first recess 35 to the other side of the lever 23, and through the second recess 36 back to the one side of the lever 23. Further, the recesses 35, 36 are formed so as to have overhanging portions 37 which, in use, serve to retain the rope in the recesses 35, 36 whilst allowing for the rope to be selectively disconnected from the lever 23. In this way, when the tail of the rope is received in the retention arrangement 25 and is moved relative to the base plate 11 of the descender 10, the lever 23 will move therewith so that the additional braking force can be easily controlled.

In an alternative embodiment (not shown) the retention arrangement 25 can be in the form of a clip or ring mounted to the lever 23 at a position spaced from the cam 22 and through which the tail of the rope can pass.

The retention plate 13 is pivotal about the same pivot axis 1 as the pivotal member 12 and allows the rope to be inserted into and removed from the descender 10 when in the open position (not shown). When the retention plate 13 is pivoted to a closed position (refer FIG. 1) it covers the gap between the two sheaves 14 and 15 and the gap between the second sheave 15 and the cam 22 to prevent the rope from accidentally jumping out of the descender during a descent. When in the closed position, a slot 34 in the retention plate 13 engages the bolt 19 in a groove formed between the stop member 20 and a nut threadably engaged on the end of the bolt 19. In this way, the retention plate 13 is securely supported and reduces the tendency for the plate 13 to twist due to side loading of the descender by the rope.

The pivotal member 12 is pivotally connected between the baseplate 11 and the retention plate 13 in a similar way to that described in U.S. Pat. No. 4,596,314 at column 4, lines 25–64. In this way, the effective centre of the first sheave 14 can be moved relative to the cam 22 so that the descender 10 can be adjusted to suit different diameter ropes.

The baseplate 11 is provided with an elongated hole 26 by which the descender 10 can be permanently connected to a harness during use, the connection being generally made by way of a carabinier. The retention plate 13 is provided with a slot 27 which opens through one side of the plate 13, the slot 27 being closed off by a closure member 28 pivotally connected to the plate 13 by a rivet 29 and which is biased into the closed position by a spring 30. To move the retention plate 13 to the closed position, the closure member 28 is pivoted in direction D and the carabinier which is already connected in the hole 26 of the baseplate 11 is passed through the opening in the slot 27. The closure member 28 is then released to retain the carabinier in the slot 27. To reopen the descender, the closure member is again depressed in the direction D and the carabinier removed from the slot 27 as the retention plate 13 is pivoted to the open position.

The baseplate 11 and retention plate 13 are also provided with holes 31,32 such that the braking action of the descender 10 may be inhibited by passing a carabinier or other suitable device through the hole 31 in the baseplate, the opening 33 in the centre of the second sheave 15 and the hole 32 in the retention plate 13 so as to hold the pivotal member 12 relative to the baseplate 11 and maintains the second sheave 15 away from the stop member 20 of the baseplate 11.

During use of the descender 10, a rope 5 is passed around the first sheave 14 between the first and second sheaves 14, 15, around the second sheave 15, between the second sheave 15 and the braking surface 24 of the variable braking mechanism 21, and through the retention arrangement 25.

A minimum braking force is obtained when the handle is pulled in the direction C towards the base and retention plates 11, 13 so as to move the second sheave 15 into a position remote from the cam 22, and wherein the rope 5 will not contact the braking surface 24 of the variable braking mechanism 21. It will be recognised, however, that even under the minimum braking situation described, the speed of travel of the rope through the descender 10 can be controlled by varying the tension on the tail of the rope 5.

When the handle 17 is released, the tension on the rope 5 and the above described tortuous path of the rope 5 through the descender 10 causes the pivotal member 12 to pivot so that the second sheave 15 is urged into contact with the cam 22 (or the rope 5 which is therebetween). Further, the lever 23 will be urged by the weight of the rope 5 and the friction of the rope 5 on the braking surface 24 into the position shown in FIG. 2. In this position of the handle 17 and lever 23, the rope 5 is pressed between the second sheave 15 and the braking surface 24 of the variable braking mechanism 21 which will create an additional braking force on the rope 5 and which is preferably sufficient to stop the descent of the user.

Since the rope 5 passes through the retention arrangement 25 on the lever 23, the user can simply move the tail of the rope 5 relative to the descender 10 so as to selectively pivot the lever 23.

When the tail of the rope 5 and the lever 23 are kept generally parallel to the longitudinal extent of the descender 10, a radially outermost portion of the cam 22 (having a radius $r_1$) faces the second sheave 15 such that the additional braking force is maximized. When the tail of the rope 5 is selectively moved laterally away from the descender 10, the lever 23 will move with the tail of the rope and pivot in the direction F whereby a radially further inner portion of the cam 20 (having a radius $r_2$ which is less than $r_1$) will face the second sheave 15. This effectively reduces the additional braking force.

In an alternate embodiment (not shown), a stop member may be mounted on the baseplate 11 (for example, about the bolt 19) to provide a fixed stop. In this embodiment, the pivoting of the lever 23 will change the distance between the braking surface 24 and the second sheave 15, and if the lever 23 is pivoted beyond a predetermined angle 'A' with respect to the longitudinal extent of the descender 10, a portion of the cam 20 having a sufficiently small radius $r_3$ faces the second sheave 15 such that the braking surface 24 of the cam 20 will no longer press the rope 5 against the second sheave 15 and there will be virtually no additional braking force.

It will be appreciated that the effective movement of the braking surface 24 relative to the second sheave 15 by simply manipulating the tail end of the rope 5 as described above will provide a smooth variation in the additional braking force. In this way the variable braking mechanism 21 allows an inexperienced user to smoothly control the application of the additional braking force and thereby avoid jerky stops and starts which can be experienced when operating the descender 10 with the handle 17. As such, the variable braking mechanism 21 provides an alternative means of disengaging the self-acting brake which is easier to control than by using the handle 17, and which does not detract from the ability of the brake to be self-acting in emergency situations.

Figure 5:
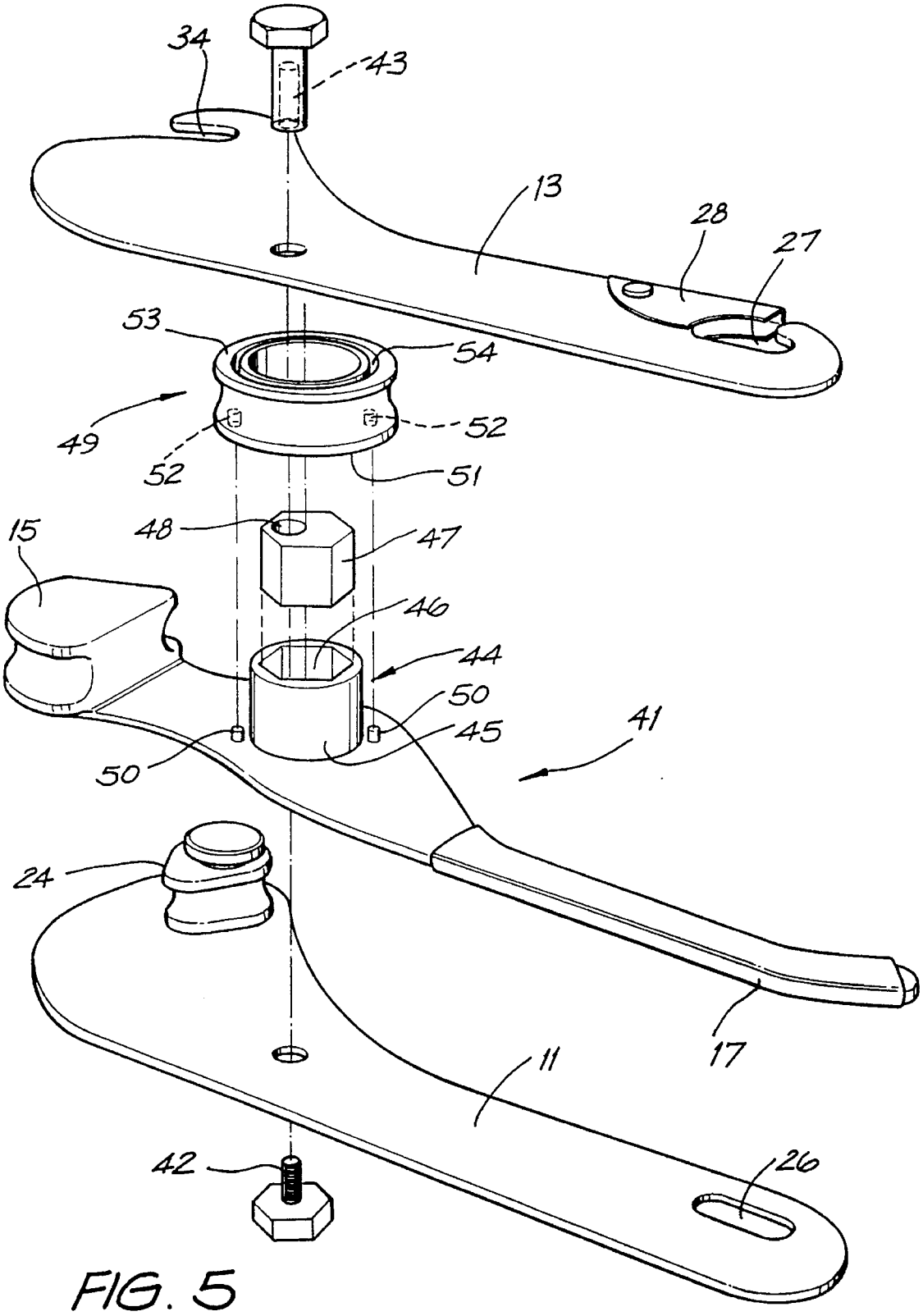
FIG. 5 shows an exploded perspective view of the descender of the second embodiment of the present invention

Referring now to FIG. 5, there is shown a second embodiment of the present invention wherein the same reference numerals are used for those features in common with the first embodiment shown in FIGS. 1–4.

As mentioned above, it has been found that the descender disclosed in U.S. Pat. No. 4,596,314, when used with a large diameter rope, can exert too great a resistance force on the rope as it passes around the first and second sheaves. In order to solve or alleviate this problem, the second embodiment of the present invention provides a descender 40 which has a first sheave 49 which is selectively freely rotatable relative to the pivotal member 12 rather than being fixed.

More particularly, the descender 40 has a pivotal member 41 which is pivotally mounted to the base plate 11 and retention plate 13 by a bolt 42 extending perpendicularly from the base plate 11, and an internally threaded tubular part 43 extending perpendicularly from the retention plate 13 which threadably receives the bolt 42. The pivotal member 41 has a tubular boss 44 having a generally circular outer bearing surface 45 and an axially extending recess 46 which is hexagonal in cross-section. An hexagonally shaped insert part 47 is received in the recess 46 of the boss 44 and has an offset through-hole 48 which receives the tubular part 43 and bolt 42. The insert part 47 can be positioned in the hexagonally shaped recess 46 at a number of different orientations so as to vary the position of the centre axis of the outer bearing surface 45 relative to the pivot axis 1 (ie. which is defined by the bolt 41 and tubular part 43). A sheave 49 having an annular form closely receives the boss 44 and cooperates with the bearing surface 45 so as to be rotatable relative to the pivotal member 41.

The pivotal member 41 has two projections 50 both at a predetermined radius so as to be on an outside of the outer bearing surface 45. Further, the sheave 49 has, on one axial end face 51, two holes 52 positioned so as to receive the projections 50 when that end face 51 faces the pivotal member 41. In this position, the sheave 49 is locked against rotation relative to the pivotal member 41. The sheave 48 also has, on its other axial end face 53, an annular recess 54 having the same radius as the projections 52 so that, when that axial face 53 faces the pivotal member 41, the projections 50 are received in the annular recess 54 and the sheave 49 is able to freely rotate.

An alternative arrangement for selectively locking the sheave 49 against rotation is to have a grubscrew or the like (not shown) mounted on either the sheave 49 or the pivotal member 41, with a hole (not shown) being provided in the other of the sheave 49 or pivotal member 41 positionable to receive the grubscrew when it is moved into an extended position projecting outwards from the sheave 49 or pivotal member 41.

It has been found that the resistance of the feed of a large diameter rope 5 through the descender 40 is beneficially decreased by the freely rotatable sheave 49 such that the speed of a descent is not unduly limited. Further, since the sheave 49 is selectively locked against rotation, the descender 40 can be used for both standard diameter ropes and large diameter ropes.

Of course the features of the first and second embodiments described above can be incorporated into the one descender if desired.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A descender for connecting a harness to a rope and operating on the rope during abseiling, the descender comprising:

a base having a connection means for connecting to said harness;

a pivotal member pivotally mounted on the base about a pivot axis extending generally normal thereof, the pivot axis being spaced from the connection means;

the pivotal member having first and second spaced projections for engaging said rope, the projections both extending generally parallel to the pivot axis with the first projection being disposed about the pivot axis and the second projection being located substantially on the opposite side of the pivot axis with respect to the connection means;

the pivotal member having a handle means for pivoting the pivotal member relative to the base; and a variable braking member, displaceably mounted on said base, having a braking surface which is selectively movable in a direction towards and away from the second projection to engage the rope between the braking surface and the second projection to effect a braking action such that, in operation, the rope passes around and between the first and second projections, and between the second projection and the braking surface will have a minimum level of resistive force applied thereto when the second projection is selectively moved away from the variable braking member by actuating the handle means, and the rope will have a maximum level of resistive force applied thereto when the handle means is released and tension of the rope causes the second projection to bear against the rope between the braking surface and the second projection and thereby create additional braking force, and wherein the additional braking force is reducible by selectively moving the braking surface in the direction away from the second projection.

2. The descender of claim 1 wherein the first and second projections define sheaves which are fixed relative to the pivotal member.

3. A descender for connecting a harness to a rope and operating on the rope during abseiling, the descender comprising:

a base having a connection means for connecting to said harness;

a pivotal member pivotally mounted on the base about a pivot axis extending generally normal thereof, the pivot axis being spaced from the connection means;

the pivotal member having first and second spaced projections for engaging said rope, the projections both extending generally parallel to the pivot axis with the first projection being disposed about the pivot axis and the second projection being located substantially on the opposite side of the pivot axis with respect to the connection means:

the pivotal member having a handle means for pivoting the pivotal member relative to the base;

a variable braking member in the form of a cam pivotally mounted on the base having a braking surface which includes a radially outer surface of the cam formed to be displaceable toward and away from the second projection when the cam is pivoted with respect to the base, the variable braking member further having a lever to selectively pivot the cam and thereby vary the distance between the braking surface and the second projection to effect a variable braking action upon the rope when the rope is disposed between said second projection and said braking surface during operation of the descender.

4. The descender of claim 3 wherein the lever has a retention means at a position spaced from the cam and through which, in use, a tail of the rope passes after emerging from between the second projection and the braking surface so that the lever will move with the tail of the rope and may be actuated by changing the position of the tail of the rope relative to the descender.

5. The descender of claim 4 wherein the retention means is in the form of a pair of recesses in the lever through which, in use, the tail of the rope is threaded.

* * * * *